US008417135B2

(12) United States Patent
Mestha et al.

(10) Patent No.: US 8,417,135 B2
(45) Date of Patent: Apr. 9, 2013

(54) METHODS TO CONTROL APPEARANCE OF GLOSS LEVELS FOR PRINTED TEXT AND IMAGES

(75) Inventors: Lalit Keshav Mestha, Fairport, NY (US); Peter A. Crean, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 425 days.

(21) Appl. No.: 12/464,610

(22) Filed: May 12, 2009

(65) Prior Publication Data

US 2010/0290797 A1 Nov. 18, 2010

(51) Int. Cl.
*G03G 15/20* (2006.01)

(52) U.S. Cl. ..... 399/56; 399/15; 399/67; 399/341

(58) Field of Classification Search ..... 399/38–40, 399/46–48, 53, 55, 56, 75, 81; 358/1.9, 3.06
See application file for complete search history.

(56) References Cited

U.S. PATENT DOCUMENTS

| | | | | |
|---|---|---|---|---|
| 5,155,530 | A | 10/1992 | Larson et al. | 355/208 |
| 5,708,916 | A | 1/1998 | Mestha | 399/49 |
| 5,950,040 | A | 9/1999 | Mestha et al. | 399/46 |
| 2004/0004731 | A1* | 1/2004 | Itagaki | 358/1.9 |
| 2007/0086803 | A1* | 4/2007 | Kimura et al. | 399/69 |
| 2007/0183800 | A1* | 8/2007 | Bessho | 399/49 |
| 2009/0087221 | A1* | 4/2009 | Masui | 399/223 |
| 2009/0245903 | A1* | 10/2009 | Nakamura et al. | 399/341 |

OTHER PUBLICATIONS

Edul N. Dalal et al., "The Effect of Gloss on Color", COLOR Research and Application, vol. 24, No. 5, Oct. 1999, pp. 369-376.
Lalit K. Mesthaet al., "Gray Balance Control Loop for Digital Color Printing Systems", Published in the proceedings of IS&T's "The 21st International Congress on Digital Printing Technologies (NIP21)", Sep. 18-23, 2005.
Prudhvi K. Gurram et al., "Comparison of 1-D, 2-D and 3-D Printer Calibration Algorithims with Printer Drift", IS&T's "The 21st International Congress on Digital Printing Technologies (NIP21)", Sep. 18-23, 2005, pp. 505-510.
L.K. Mestha et al., "Advances Towards High Quality Color Profiling", Published at the "2nd Annual XIG Conference", May 13-15, 2008.
L. K. Mestha et al., "Control of Color Imaging Systems: Analysis and Design", CRC Press, ISBN: 9780849337468, May 2009, Chapter 10.
L. K. Mestha et al., "One-Dimensional, Two-Dimensional, and Spot-Color Management Control Methods", CRC Press, ISBN: 9780849337468, May 2009, Chapter 8.

* cited by examiner

*Primary Examiner* — Walter L Lindsay, Jr.
*Assistant Examiner* — Jessica L Eley
(74) *Attorney, Agent, or Firm* — Pillsbury Winthrop Shaw Pittman, LLP

(57) ABSTRACT

A method for adjusting gloss appearance of images using a printer, includes: receiving a gloss selection input; correlating the gloss selection to a toner density setpoint value; adjusting one or more actuator controls such that the printer is configured to print using the toner density setpoint value; and rendering an image on a substrate using the one or more adjusted actuator controls. A printer configured to adjust gloss appearance of images is also disclosed.

25 Claims, 5 Drawing Sheets

METHODS TO CONTROL APPEARANCE OF GLOSS LEVELS FOR PRINTED TEXT AND IMAGES

FIELD

This application generally relates to printing, and in particular, adjusting gloss levels in printers.

BACKGROUND

Digital production color printers, such as the Xerox Corp. DocuColor™ 5000 and 8000 Digital Presses, may show excessive gloss levels in color prints particularly when images with dark shadow colors are printed.

Advanced destination profiles typically provided in the printer contain a Gray Component Replacement (GCR) module which sets the amount of process color separations (e.g., CMYK) to be used appropriately. GCR adds black process color separations. Particularly for dark colors, adjusting or modifying GCR is one way to reduce the gloss level. This process, however, can be difficult and complex since modifying GCR may induce contours depending on the way GCRs are designed. Since GCR is important to high quality color reproduction using toners or inks, many print vendors fine tune the addition of black intelligently either by using complex algorithms or by carefully designed experiments. Experiments are often done with many iterations. Once tuning is completed, the GCR becomes part of the profile look-up table (LUT). Often for International Color Consortium (ICC) workflow, it is saved as the ICC profile.

Another way for reducing gloss levels is by introducing low gloss toners and improvement to the fusing subsystems. This approach is extremely complex and may also be very expensive.

As such, customer expectations for gloss have not always been completely fulfilled.

SUMMARY

According to one embodiment, a method for adjusting gloss appearance of images using a printer comprises: receiving a gloss selection input; correlating the gloss selection to a toner density setpoint value; adjusting one or more actuator controls such that the printer is configured to print using the toner density setpoint value; and rendering an image on a substrate using the one or more adjusted actuator controls.

According to another embodiment, a printer configured to adjust gloss appearance of images comprises: a marking engine configured to render an image on a substrate from input image data; and a controller configured to: (i) receive a gloss selection input; (ii) correlate the gloss selection to a toner density setpoint value; (iii) adjust one or more actuator controls such that the printer is configured to print using the toner density setpoint value.

Other features of one or more embodiments of this disclosure will seem apparent from the following detailed description, and accompanying drawings, and the appended claims.

BRIEF DESCRIPTION OF THE DRAWINGS

Embodiments of the present disclosure will now be disclosed, by way of example only, with reference to the accompanying schematic drawings in which corresponding reference symbols indicate corresponding parts, in which.

DETAILED DESCRIPTION

Figure 1:
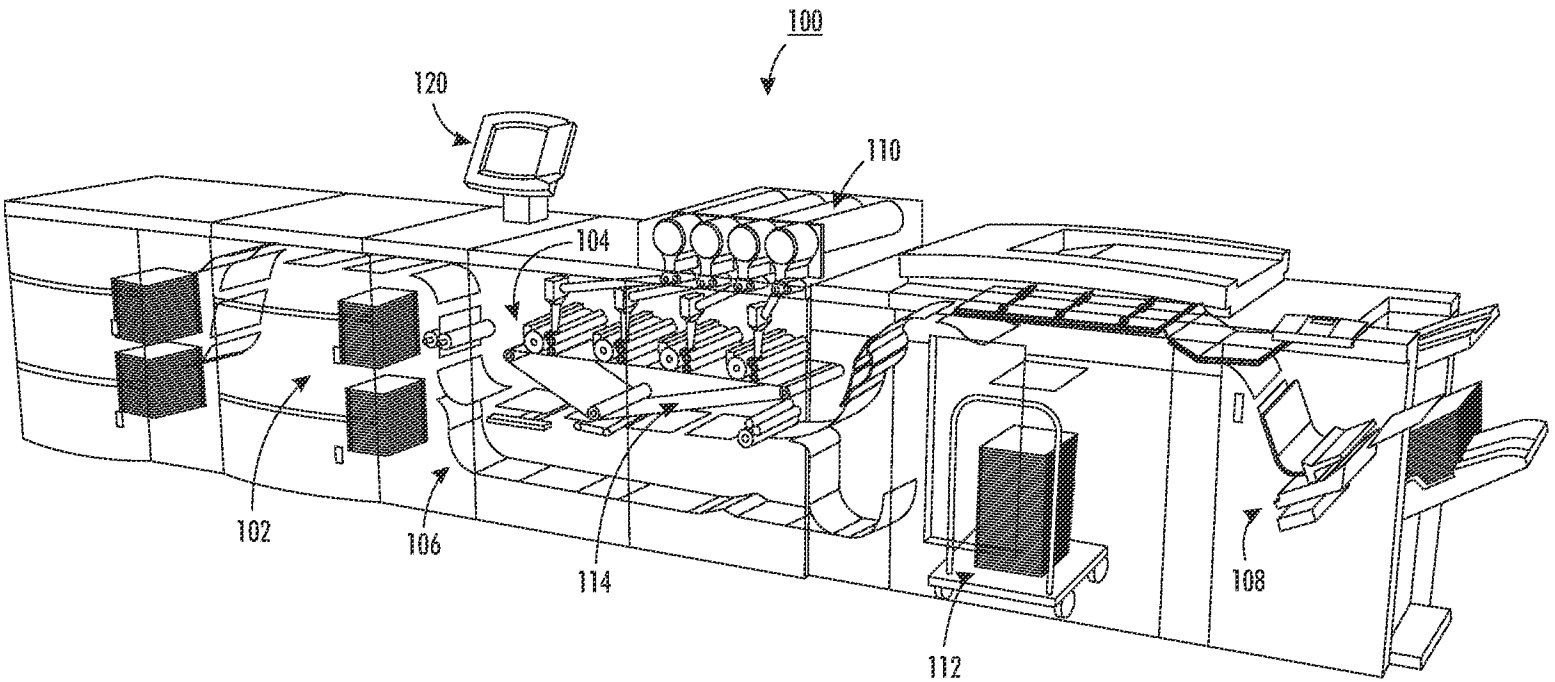
FIG. 1 shows a printer in accordance with an embodiment.

FIG. 1 shows a schematic illustration of a printer 100, in accordance with an embodiment. The printer 100 generally includes one or more sources 102 of printable substrate media that are operatively connected to a printing (or marking) engine 104, and output path 106 and finisher 108. As illustrated, the print engine 104 may be a multi-color engine having a plurality of imaging/development subsystems 110 that are suitable for producing individual color images. A stacker device 112 may also be provided as known in the art.

The print engine 104 may mark xerographically. In one implementation, the printer 100 may be a Xerox Corp. DocuColor™ 8000 Digital Press. For example, the print engine 104 may render toner images of input image data on a belt 114, where the belt 114 then transfers the images to the substrate.

A display device 120 may be provided to enable the user to control various aspect of the printing system 100, in accordance with the embodiments disclosed therein. The display device 120 may include a cathode ray tube (CRT), liquid crystal display (LCD), plasma, or other display device.

The printer 100 may accept content for images in any one of a number of possible formats, such as, for example, TIFF, JPEG, or Adobe® PostScript®. This image content is then "interpreted" or "decomposed" in a known manner into a format usable by the marking engine controller. The input image data may be represented in terms of the constituent process colors according to the color space model (e.g., CYMK, RGB, L*a*b*, etc.). Device dependent color space values, such as RGB and CYMK input image data, may be converted to a device-independent color space, such as CIE-LAB color space, using transformation algorithms or LUT, as known in the art, for example, using ICC color management profiles associated with a printer.

In CIE-LAB (L*, a*, b*) color space L* values correspond to the luminance dimension, and a* and b* correspond to chromatic values, i.e., green-magenta and blue-yellow, respectively. While CIE-LAB color space is disclosed, it will be appreciated that other device-independent color spaces could also be used, such as, for example, CIE 1976 (L*, u*, v*), CIE XYZ, or LCH.

Figure 2:
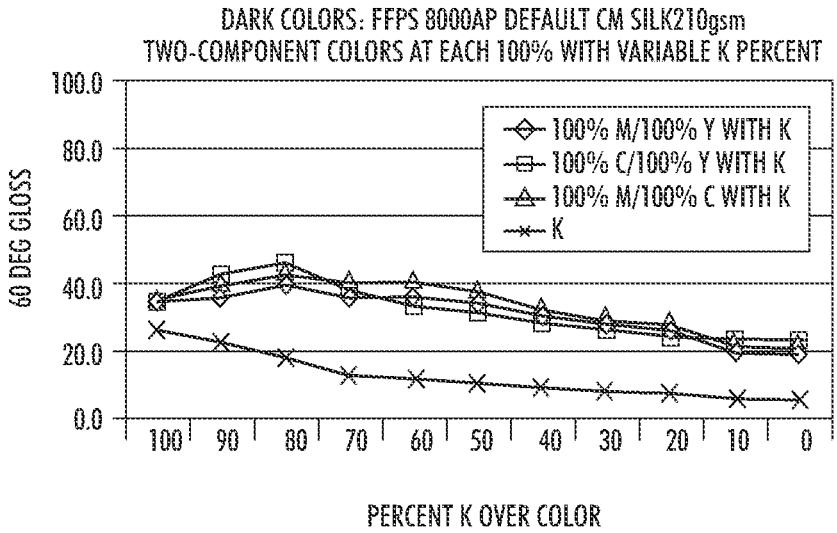
FIG. 2 shows gloss variation with respect to toner area coverage in black (K) and when black toner is mixed with other CMY toner separations.

FIG. 2 shows the gloss levels for various test patches that were printed on Silk 210 grams per square meter (gsm) paper using a conventional Xerox Corp. DocuColor™ 8000 Digital Press. Gloss measurements were taken at a 60 degree geometry. The plots show gloss levels for black (K) toner patches and black (K) toner printed on top of magenta-yellow (MY), cyan-yellow (CY) and magenta-cyan (MC) toner patches. Each of the colored patches, the cyan (C), magenta (M), and/or yellow (Y) toner remained at 100% toner area coverage, while the toner area coverage of black (K) toner was varied. As the plots show, the greater the mass of the toner, and in particular black toner, the more glossy the resulting image. This is because the printer 100 uses more black toner to cover the darker part of the color gamut.

In a related application, U.S. patent application Ser. No. 12/421,745 filed on Apr. 10, 2009, herein incorporated by reference in its entirety, a gloss control method and system is disclosed. Gloss levels may be controlled by adjusting one or more parameters, including the minimum luminance value L*min to be used by the printer, of a black point compensation (BPC) algorithm. The gloss levels for black text, however, may not be fully controlled using this approach because text may be sent directly to the printer without being processed through the color management profile. Text is typically printed at high density, for example, at 100% toner area coverage.

According to an embodiment of the present disclosure, gloss levels may be controlled by controlling the toner density within the printer. In particular, by adjusting the maximum toner density setpoint, the printed toner mass, and thus gloss, may be controlled. One or more actuator controller of the printer may be adjusted to achieve the toner density setpoint. This approach may be used independently of any adjustments to color management profiles.

The basic xerographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

The surface of the photoconductive member must be charged by a suitable device prior to exposing the photoconductive member to a light image, whether using a drum-type or an endless belt-type photoconductive member. This operation is typically performed by a corona charging device. One type of corona charging device comprises a current carrying electrode enclosed by a shield on three sides and a wire grid or control screen positioned thereover, and spaced apart from the open side of the shield. Biasing potentials are applied to both the electrode and the wire grid to create electrostatic fields between the charged electrode and the shield, between the charged electrode and the wire grid, and between the charged electrode and the (grounded) photoconductive member. These fields repel electrons from the electrode and the shield resulting in an electrical charge at the surface of the photoconductive member roughly equivalent to the grid voltage. The wire grid is located between the electrode and the photoconductive member for controlling the charge strength and charge uniformity on the photoconductive member as caused by the aforementioned fields.

Control of the field strength and the uniformity of the charge on the photoconductive member is very important because consistently high quality reproductions are best produced when a uniform charge having a predetermined magnitude is obtained on the photoconductive member.

Achieving consistent print color quality in the xerographic imaging device is a difficult control problem. To ensure satisfactory print quality, the developed mass per unit area (DMA) must be controlled. DMA may be controlled by the adjusting one or more control actuators, such as the development field voltage, intensity of the laser light and charge on the photoconductor.

Optical and/or voltage sensors are typically used to measure toner development values on the photoreceptor that represent the DMA. Typically process control system of a toner imaging device use a feedback loop to control image reflective density. Image reflectance density if measure and used to adjust toner development parameters, such as the development field, to obtain a desired reflectance density of subsequent prints and to maintain the DMA in a desired range.

Maximum Density ("Dmax") is the maximum Developed Mass per unit Area (DMA) on the photoconductor for each of the color separations. This translates to maximum Transferred Density ("Tmax"), which is the maximum Transferred Mass per unit Area (TMA) on the substrate once the toner is transferred to the printed substrate. In particular, Dmax (Tmax) correspond to the density of a halftone having a 100% toner area coverage when printed.

Dmax and TMA may be assumed in some instances to equal in value. Dmax is an important factor in image quality because it determines the range of tones that can be produced in the printer. For example, the Dmax values the Xerox Corp iGen4® Digital Production Press typically range from about 0.9-1.6 mg/cm$^2$.

A gloss level vs. Dmax (Tmax) model may be used to determine an indication of the desired level of Dmax adjustments. This may include a look-up table, function, empirical data, etc. In some implementations, the type of substrate may also be considered. For example, empirical data may be utilized to better correlate different user-input gloss values to Dmax values for various types of substrates, toner, and/or fusing temperatures. A plot, function, curve-fitting technique, or look-up table may be used.

In one embodiment, TMA values may be used instead of Dmax values. As discussed above, the Tmax is related to Dmax. For example, the two values may be assumed to be equal, although in actuality, this does not occur. Thus, a transfer efficiency constant could also be applied in some implementations.

Figure 3:
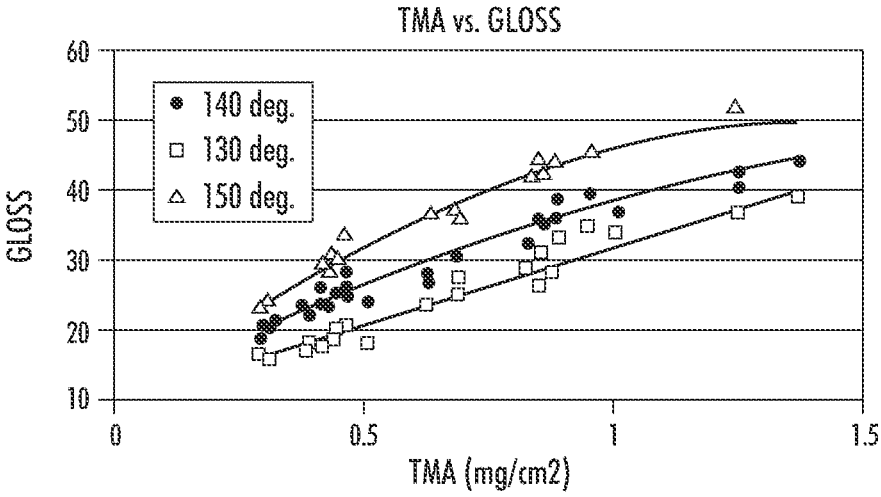
FIG. 3 shows measured gloss as a function of Transferred Mass per Area (TMA)

FIG. 3 shows a plot of measured gloss as a function of TMA in units of milligrams of toner per centimeter squared (mg/cm$^2$).

The data was created by fusing toner patches for cyan, magenta, yellow, black, red (magenta with yellow), green (cyan with yellow) and blue (cyan with magenta) for varying TMA and fuser temperatures and taking gloss measurements thereof.

The plots show a generally quadratic relationship between gloss and TMA. A best fit line is provided for the data, for the fuser temperatures of 130, 140 and 150° C., respectively. As apparent, gloss is a substantially linear with temperature with the gloss level plots for 130, 140 and 150° C. being substantially parallel. The relationship between gloss and Transferred Mass per Unit Area is further described in Chapter 10 of L. K. Mestha & S. Dianat, "Control of Color Imaging Systems: Analysis and Design", CRC Press, ISBN: 9780849337468, May 2009, herein incorporated by reference in its entirety.

Gloss may be controlled by adjusting the toner mass to lower the mass of a particular toner color separation. The lower the toner mass results in lower gloss levels, which in turn can provide lowered gloss in both texts and images. In particular, a Dmax or Tmax setpoints may be adjusted.

For example, referring to the data in FIG. 3, a gloss level of 40 gloss (60° gloss) would correspond to a Dmax (Tmax) setpoint value of about 0.75 mg/cm$^2$ at 150° C.

The toner density setpoint may be adjusted for one or more of the process toner colors (e.g., CMYK). However, gloss improvement may be realized most significantly by reducing the toner density setpoint for black toner. Reducing toner density setpoints for the black (K) toner separation can lower the mass of black (K) toner, which in turn affects gloss levels substantially, since lower toner density for black toner (K) results in lower gloss levels on the printed substrate.

Various techniques are known for maintaining DMA setpoints by controlling actuators. Dmax (Tmax) could be similarly controlled. For example, the Dmax setpoint value could be input as a "target" value to a feedback controller, as disclosed, in U.S. Pat. Nos. 5,950,040 and 5,708,916, which are herein incorporated by reference in their entireties.

Dmax setpoint changes are made in the process controls technology. Other "Appearance Controls" may be performed using a color management profiles. These may be stored in a profile Look Up Table (LUT), for example, in a memory device.

Once the control actuator(s) have been adjusted to the toner density setpoint value, new calibration Tone Reproduction Curves (TRC) may be generated for the printer. For example, a calibration routine may be performed inside the printer or via an associated Digital Front Ends (DFE) for generating the TRC For instance, a conventional TRC generating procedure may be used, such as is described in Chapter 8 of L. K. Mestha & S. Dianat, "Control of Color Imaging Systems: Analysis and Design", CRC Press, ISBN: 9780849337468, May 2009, herein incorporated by reference in its entirety.

New device-specific color management profiles may be generated as well. The color management profile may include a multidimensional color correction look up table (LUT) which includes a series of nodes in input color space (e.g., L*a*b* or XYZ), and device specific (e.g., CMYK) output values stored at each node. When the input pixels coincide with the nodes of the LUT, the corresponding device specific color values are retrieved directly from the LUT. If, however, the pixels are not on the node, then they may be derived via interpolation of neighboring nodes using a conventional technique. In one implementation, as tetrahedral interpolation may be used.

An initial step in building a profile is to derive a forward characterization model that maps device-specific (e.g., CMYK or RGB) representation to visual device independent (e.g., L*a*b*) color representation. A conventional technique, for example, based on a spectral cellular Yule-Nielsen-corrected Neugebauer model (SCYNN) might be used.

The updated TRC and color management profiles may be uploaded to the print controller or DFE for rendering images.

Figure 4:
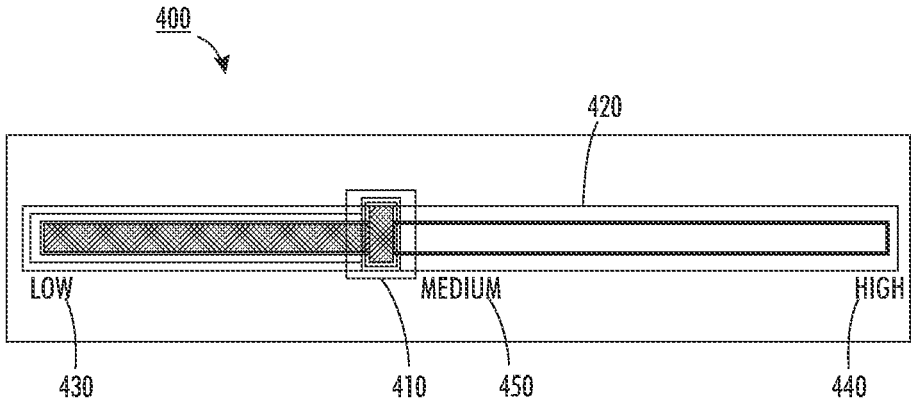
FIG. 4 shows an exemplary slider for gloss control in accordance with an embodiment.

FIG. 4 shows an exemplary slider 400 for gloss control in accordance with an embodiment. Slider 400 generally includes a slide bar 410 which slides along a track 420. Minimum and maximum values 430, 440 may be provided at the distant ends of the track 420 representing the extreme gloss level inputs and, optionally one or more intermediate values 750. In some implementation, graduation marks, a scale, and/or various gloss values might be provided along the track. The user-input gloss value may be in terms of relative gloss and/or other gloss measurements, such as gloss units (gu). In one implementation, "low," "medium," and "high" relative gloss input references may be provided. As the user manipulates slider bar 410, the current gloss level might also be displayed.

The slider 400 may be implemented mechanical or electromechanically. For example, the slider bar may include a slidable lever mechanism, which a user can physically move back and forth along the track. A touch-screen display might also be provided which permits the user to virtually move the slider bar across the track, such as in display device 120 (FIG. 1).

Other slider mechanisms might also be used. For example, the slider may include one or more mechanical elements, such as, for example, knobs, buttons, levers, switches, toggles, or the like. Alternatively or additional, one or more "virtual" slider mechanisms such as, pop-up or drop-down "windows," touch screens, text-input boxes, or the like may be implemented using a graphical user interface. A joystick, mouse, stylus, trackball, lightpen and/or other input-device might also be used.

In accordance with one or more embodiments, different gloss inputs may be correlated with toner density values. In some implementations, a look-up-table may be provided. In one implementation, "high gloss," "medium gloss," and "low gloss," may have toner density (Dmax) setpoints values of 0.6, 1.1 and 1.6 mg/cm$^2$, respectively. These Dmax setpoints correspond to gloss values of approximately 0 to 60 gloss units (gu). Of course, gloss values are also dependent on the media type, which is an inherent characteristic thereof. In particular, dull and satin/silk stocks have a glossier, more even finish typically than matte coated stocks, but are not as shiny as gloss stocks.

A gloss versus Dmax (Tmax) function could also be provided. For example, empirical data may be utilized to better correlate different user-input gloss values to Dmax (Tmax) values for various types of substrates. A plot, function, curve-fitting technique, or look-up table may be used.

Figure 5:
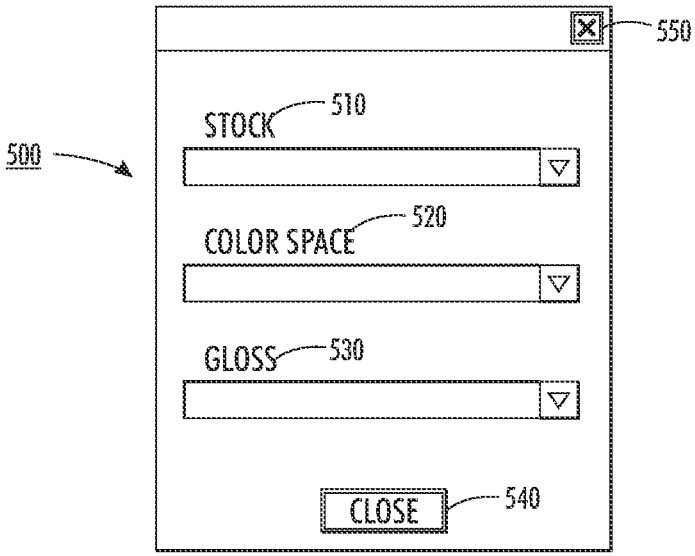
FIG. 5 shows an exemplary user-interface window for gloss control in accordance with an embodiment.

FIG. 5 shows an exemplary user-interface window 500 for gloss control, in accordance with an embodiment. The window 500 may be provided in the display device 120 (FIG. 1). The window 500 may include one or more parameter controls, such as, for example, stock control 510, color space control 520, and gloss control 530. A close button 540 and/or shortcut button 550 may also be provided for closing the window 500. Controls 510, 520, 530 may include drop-down boxes having various selections for the user to choose. In some implementations, the user may use an input device such as a stylus, mouse, etc., or even a finger, if the display is a touch screen. Stock control 510 may include options to select the printed media type. Color space 520 may include options to select one or more of CMYK, RGB, or other color spaces, as known in the art.

Gloss control 530 option may be used to select gloss levels. In one implementation, gloss control 530 may include user-selectable options of "high," "medium," and "low." These options may correspond to Dmax (Tmax) setpoints values of 0.6, 1.1 and 1.6 mg/cm$^2$, respectively. Other options might also be provided, such as graduation marks, a scale, and/or various gloss values might be provided. The user-input may in terms of relative gloss and/or other gloss measurements, such as gloss units (gu).

According to a further embodiment, adjustment of the toner density setpoints may be used in addition with adjustment of one or more parameters of a black point compensation (BPC) function, including a minimum luminance value L*min parameter, as discussed in U.S. patent application Ser. No. 12/421,745, mentioned above. For example, in one implementation, if the user is not satisfied with the gloss levels with adjusting either the toner density setpoint or L*min parameter, the user may then adjust the other of the two. In other embodiments, the embodiments disclosed herein may be used in conjunction with a Gray Component Replacement (GCR) technique to reduce the mass on mixed colors. All three approaches may be used together to achieve optimal print gloss quality.

Figure 6:
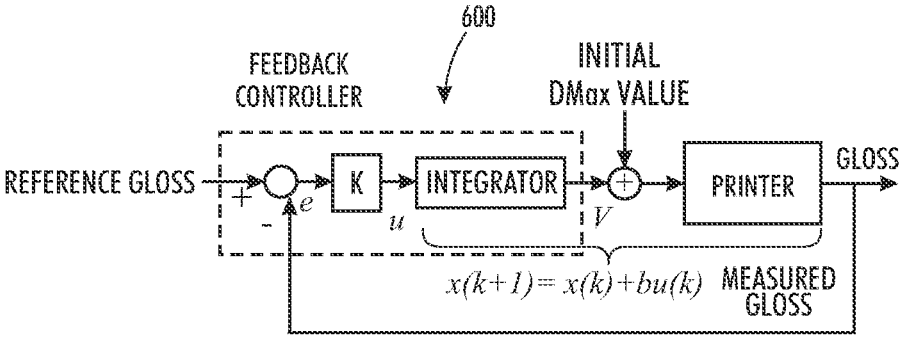
FIG. 6 shows an exemplary feedback gloss controller in accordance with an embodiment.

FIG. 6 shows an exemplary feedback gloss controller in accordance with an embodiment for adjusting gloss levels in say black text.

Actual gloss may be measured using a gloss sensor and a feedback controller is provided for maintaining a "reference gloss." The gloss sensor may be located in the main document path of the printer and is configured to measure the gloss of the printed test patterns (as well as printed documents, if desired). The reference gloss may be user-inputted, or perhaps a predetermined or default parameter of the printer. For example, the reference gloss may be 40 gloss (60° gloss).

In a calibration mode, one or more test patches may be printed with 100% black for adjusting gloss level in black text. The measured gloss is then compared to the reference gloss input to the controller to generate error signal e.

The error signal e is weighted by gain factor K, thus producing gain weighted signal u, which is integrated to yield V that is used for determining the toner density setpoint value, such as Dmax, in accordance with the embodiments discussed above. Accordingly, the gloss selection may be adjusted using a transfer function, according to equation (12).

$$x(k+1)=x(k)+b\cdot u(k) \tag{12}$$

where: x=gloss; and b=first derivative between gloss (output) to Dmax (input).

The gain matrix may be calculated using b so as to make the feedback loop converge to the desired reference gloss value.

Other transfer functions could also be used. The adjusted gloss selection may then be used to determine the toner density setpoint value. Accordingly, the reference gloss value may be maintained by the printer.

In other embodiments, the measured gloss value from the gloss sensor may be used as an indicator of actual gloss in the system. For example, the current gloss level (FIG. 4) may be updated accordingly via measurements from the gloss sensor. Knowledge of the actual gloss level may aid the user in selecting a desired gloss level.

Figure 7:
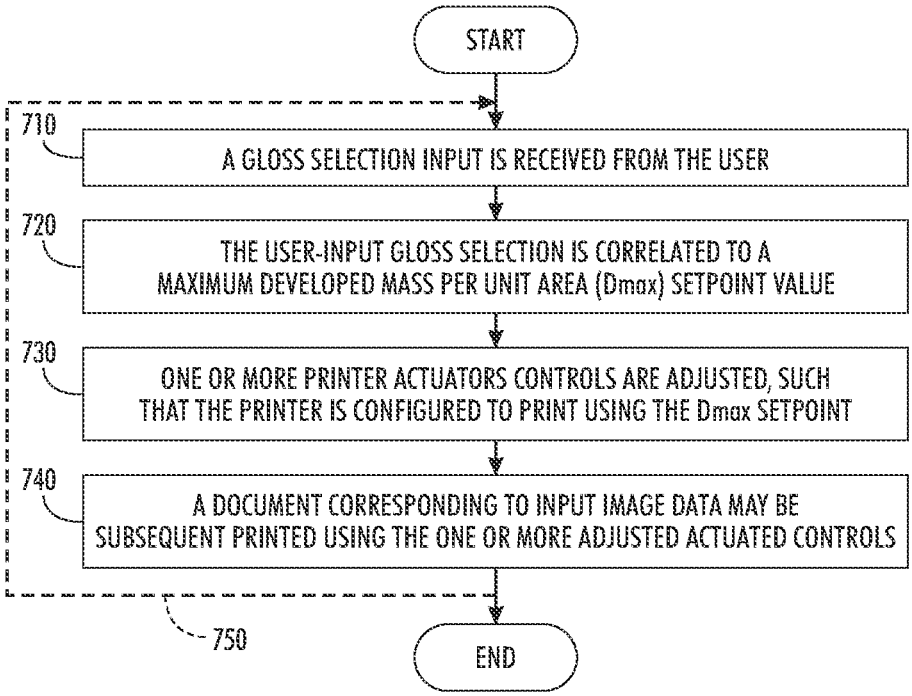
FIG. 7 shows an exemplary method for adjusting the gloss appearance of images using a printer in accordance with an embodiment.

FIG. 7 shows an exemplary method 700 for adjusting the gloss appearance of images using a printer in accordance with an embodiment.

In step 710, the printer receives a gloss selection input from a user. It will be appreciated that in an alternative embodiment, the gloss selection may be obtained from a sensor, for example, a gloss sensor as discussed above. As disclosed herein, a gloss control user interface (see, e.g., FIGS. 4 and 5) may be associated with the printer system 100 that is configured to allow users to adjust the glossy appearance of images. For example, the gloss control user interface may be a slider or a graphical user interface (GUI) which is located on the display device and/or at other locations on the printer 100.

Next, in step 720, the user-input gloss selection is correlated to a toner density setpoint value to be used by the printer. This may include a look-up table, function, empirical data, etc. In some implementation, the type of substrate may also be considered.

Continuing to step 730, one or more actuator controls of the printer may be adjusted such that the printer is configured to print using the toner density setpoint value. Once, the actuator controls have been adjusted, a Tone Reproduction Curve (TRC), and/or a color management profile for the printer may be updated.

In step 750, a document may be subsequently printed based using the adjusted actuator controls. The method may then end, or as in step 760, the method may repeat multiple times, for example, when a user updates or alters a gloss control selection via a user-interface.

If gloss levels are not improved then a black point compensation (BPC) function and/or a Gray Component Replacement (GCR) technique may also be applied to control gloss.

A controller may be provided to control the Various elements and sequence of operations of the printing system 100 (FIG. 1) in accordance with the various embodiments disclosed herein. In some implementations, the controller may be dedicated hardware like ASICs or FPGAs, software (firmware), or a combination of dedicated hardware and software. For the different applications of the embodiments disclosed herein, the programming and/or configuration may vary. In one embodiment, the controller may be a digital front end (DFE) associated with the printer.

The term "media," as used herein, may include a sheet of paper, such as a standard 8½×11 inch letter paper, A4 paper, or 8½×14 inch legal paper. However, it will be appreciated that "media" may include other sizes and printable media types, such as, bond paper, parchment, cloth, cardboard, plastic, transparencies, film, foil, or other print media substrates. Any reference to paper is not to be construed as limiting. Different grades and/or gloss media may be used.

While this disclosure has been described in connection with what is presently considered to be the most practical and preferred embodiment, it is to be understood that it is capable of further modifications and is not to be limited to the disclosed embodiments, and this disclosure is intended to cover any variations, uses, equivalent arrangements or adaptations of the inventive concepts following, in general, the principles of the disclosed embodiments and including such departures from the present disclosure as come within known or customary practice in the art to which the embodiments pertains, and as may be applied to the essential features hereinbefore set forth and followed in the spirit and scope of the appended claims.

What is claimed is:

1. A method for adjusting gloss appearance of images using a printer, comprising:

receiving a gloss selection input;

correlating the gloss selection input to a toner density setpoint value;

adjusting one or more actuator controls such that the printer is configured to print using the toner density setpoint value;

rendering an image on a substrate using the one or more adjusted actuator controls;

measuring the gloss of the rendered image; and adjusting the toner density setpoint value corresponding to the gloss selection input using the measured gloss, wherein the toner density setpoint value is a maximum Transferred Mass per unit Area (Tmax) on the substrate.

2. The method according to claim 1, wherein receiving the gloss selection input comprises:

receiving the gloss selection input from a user.

3. The method according to claim 2, further comprising:

providing an user interface for receiving the gloss selection input from the user.

4. The method according to claim 3, wherein the user interface comprises a slider.

5. The method according to claim 3, wherein the user interface comprises a graphical user interface.

6. The method according to claim 5, wherein the graphical user interface comprises a window.

7. The method according to claim 1, wherein receiving the gloss selection input comprises:

receiving the gloss selection input from a gloss sensor.

8. The method according to claim 7, further comprising:

comparing the measured gloss and the gloss selection input to generate an error value and using the error value to adjust the toner density setpoint value corresponding to the gloss selection input.

9. The method according to claim 1, wherein the maximum Transferred Mass per unit Area (Tmax) is related to maximum Developed Mass per unit Area (Dmax) on the photoconductor.

10. The method according to claim 1, further comprising:

applying a black point compensation (BPC) function and/or a Gray Component Replacement (GCR) technique to control gloss.

11. The method according to claim 1, wherein the one or more actuator controls comprise: laser light intensity, photoconductor charge, development voltage, or setpoints for process control system.

12. The method according to claim 1, further comprising:

adjusting a Tone Reproduction Curve (TRC), and/or a color management profile for the printer after adjusting the one or more actuator controls.

13. A printer configured to adjust gloss appearance of images comprising:

a marking engine configured to render an image on a substrate from input image data; and a controller configured to: (i) receive a gloss selection input; (ii) correlate the gloss selection input to a toner density setpoint value, wherein the toner density setpoint value is a maximum Transferred Mass per unit Area (Tmax) on the substrate; (iii) adjust one or more actuator controls such that the printer is configured to print an image using the toner density setpoint value; (iv) receive measured gloss of the printed image; and (v) adjust the toner density setpoint value corresponding to the gloss selection input using the measured gloss.

14. The printer according to claim 13, further comprising a user interface that is configured to receiving the gloss selection input from a user.

15. The printer according to claim 14, wherein the user interface comprises a slider.

16. The printer according to claim 14, wherein the user interface comprises a graphical user interface.

17. The printer according to claim 16, wherein the graphical user interface comprises a window.

18. The printer according to claim 13, further comprising:

a gloss sensor for measuring gloss of a printed substrate, wherein the gloss selection input comprises the measured gloss.

19. The printer according to claim 18, wherein the controller is configured to generate an error value by comparing the measured gloss and the gloss selection input and configured to adjust the toner density setpoint value corresponding to the gloss selection input using the error value.

20. The printer according to claim 13, wherein the maximum Transferred Mass per unit Area (Tmax) is related to maximum Developed Mass per unit Area (Dmax) on the photoconductor.

21. The printer according to claim 13, wherein the controller is configured to apply a black point compensation (BPC) function and/or a Gray Component Replacement (GCR) technique to control gloss.

22. The printer according to claim 13, wherein the one or more actuator controls comprise: laser light intensity, photoconductor charge, development voltage, or setpoints for process control system.

23. The printer according to claim 13, wherein the controller is configured to adjust a Tone Reproduction Curve (TRC), and/or a color management profile for the printer after adjusting the one or more actuator controls.

24. The method according to claim 8, wherein the error value is weighted by a gain factor to obtain a gain weighted signal u, and wherein the gain weighted signal u is integrated to yield an output value, and wherein the output value is used to determine the toner density setpoint value.

25. The method according to claim 24, wherein the toner density setpoint value is determined using a transfer function, according to the equation:

$$x(k+1)=x(k)+b\cdot u(k)$$

where:

x=gloss;

k=increment;

u=the gain weighted signal; and b=first derivative between gloss and the toner density setpoint value.

* * * * *